United States Patent [19]

Duggins et al.

[11] 4,233,736

[45] Nov. 18, 1980

[54] PRESSURE SENSITIVE PICTURE FRAME MAT OPENING CUTTER

[75] Inventors: Richard W. Duggins, Cedar Grove; James W. Rodgers, Durham, both of N.C.

[73] Assignee: Framework, Inc., Cedar Grove, N.C.

[21] Appl. No.: 95,660

[22] Filed: Nov. 19, 1979

Related U.S. Application Data

[63] Continuation-in-part of Ser. No. 916,898, Jun. 19, 1978, abandoned.

[51] Int. Cl.[3] ..... B26B 29/00

[52] U.S. Cl. ..... 30/293

[58] Field of Search ..... 30/290, 293

[56] References Cited

U.S. PATENT DOCUMENTS

| | | | |
|---|---|---|---|
| 2,924,010 | 2/1960 | Umholtz | 30/293 |
| 4,064,626 | 12/1977 | Meshulam et al. | 30/293 |
| 4,176,452 | 12/1979 | Duggins et al. | 30/293 |

*Primary Examiner*—Othell M. Simpson
*Assistant Examiner*—J. T. Zatarga
*Attorney, Agent, or Firm*—B. B. Olive

[57] ABSTRACT

A picture frame mat opening cutter is adapted for cutting both circles and ovals and depth of cut can be controlled by the amount of downward pressure applied during use. The cutter body mounts a retractable cable wound on a rotatable spool; a cutting blade mounted on a spring-loaded, slidable support bar; and a rotatable, vertically movable control knob which bears on the support bar and is manually grasped and manipulated for moving the cutter and controlling the depth of cut according to the amount of pressure applied to the knob. Beveled oval and circular picture frame mat openings are cut utilizing the retractable cable in conjunction with positioning pins on the surface of a mat to be cut. By modification, straight line cuts are also obtainable.

8 Claims, 11 Drawing Figures

FIG. 4
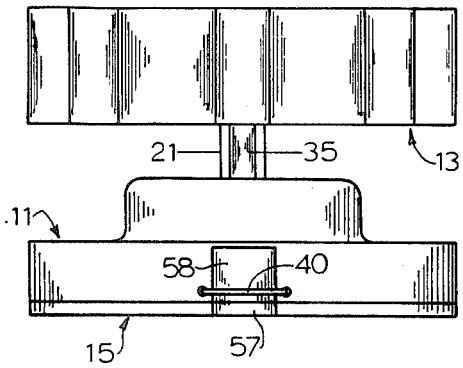
FIG. 5
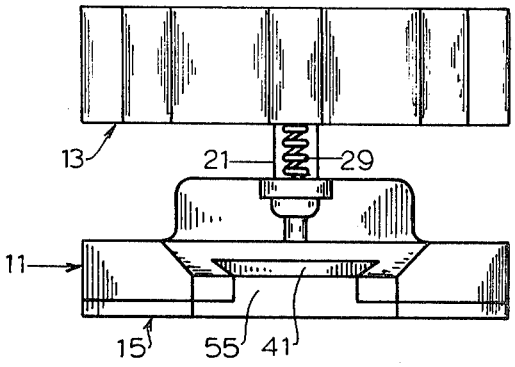
FIG. 6
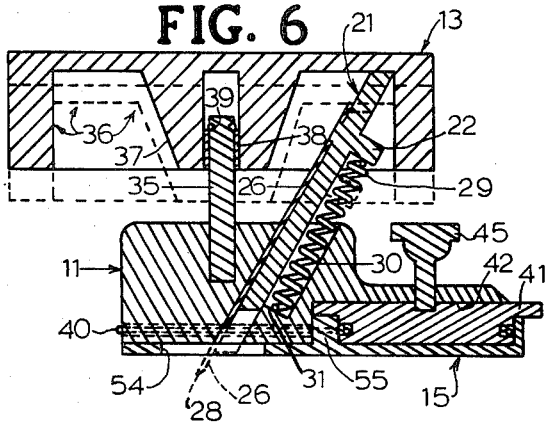
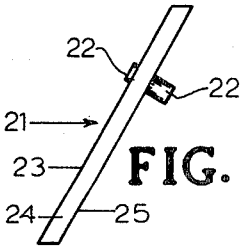
FIG. 7
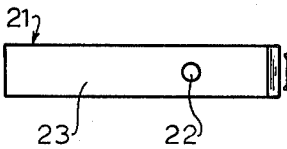
FIG. 8
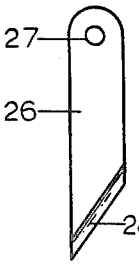
FIG. 9
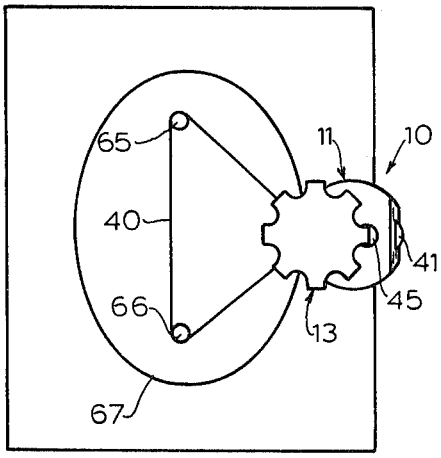
FIG. 11
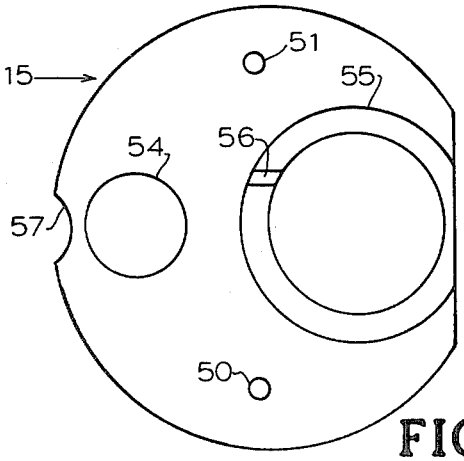
FIG. 10

PRESSURE SENSITIVE PICTURE FRAME MAT OPENING CUTTER

CROSS-REFERENCE TO RELATED COPENDING APPLICATION

This application is related to copending application Ser. No. 909,673, filed May 25, 1978, entitled "PICTURE FRAME MAT OPENING CUTTER" and is a continuation-in-part of Ser. No. 916,898, filed June 19, 1978, entitled "PRESSURE SENSITIVE PICTURE FRAME MAT OPENING CUTTER", now abandoned.

BACKGROUND OF THE INVENTION

1. Field of the Invention:

The cutter of the invention relates to devices intended for cutting oval and circular picture frame mat openings.

2. Description of the Prior Art:

It has been previously known to provide a picture frame mat opening cutter having a retractable spool wound cable and adjustable cutter blade arrangement for use with mat positioning pins to cut beveled oval and circular openings for picture frame mats. Such a device has been sold as the Frameworks oval mat cutter by Frameworks, Inc., Route 1, Box 56, Cedar Grove, NC 27231. Such a device has been sold on a widespread basis and the construction and operation of the same has become known among those engaged in the picture framing business.

Copending application Ser. No. 909,673 provides a precision mat opening cutter which, like the previously-mentioned Frameworks oval mat cutter, incorporates a retractable cable and adjustable cutting blade arrangement which can be used in conjunction with mat positioning pins on the working surface to cut beveled oval and circular openings in picture frame mats. The copending application incorporates an adjustable template guide with the Frameworks oval mat cutter which mounts in a slot provided on the bottom surface of the Frameworks oval mat cutter and which adapts such cutter to being used with a template to cut special mat opening shapes. The template guide can be placed in a position to be used with a template or can be placed in a reversed stored position when special shapes are not being cut requiring the use of a template. An alternative embodiment of the copending application provides a template guide which is fixed in the cutter bottom surface but can be deployed or retracted without any necessary adjustment by the operator.

While the original Frameworks oval and circular mat opening cutter and that of the copending application have provided relatively simple, easy to use devices, their use has indicated a need for further improvement with regard to providing a means for assuring a tangential relation between the blade and the cut, as well as simplifying the use of the blade depth setting mechanism.

Other prior art is also recognized. Graphic Engineering and Manufacturing, Inc., 754 W. Algonquin Road, Arlington Heights, IL 60005, advertises and sells a cutter capable of cutting ovals and circles of various sizes utilizing patterns. This cutter is advertised as "The Logan Oval Mat And Glasscutter". This device, however, does not provide the pressure feature sought by the present invention. Also, U.S. Pat. No. 4,064,626 provides a "Cutter For Sheet Material" for cutting picture frame mat material but which makes only straight line cuts. In comparison, the device of the present invention lends itself to cutting ovals and circles.

The object of the present invention is, thus, to provide an improved picture frame mat opening cutter for cutting ovals and circles which provides a means for enabling the amount of downward pressure applied to the cutting blade during cutting to control the depth of cut and, unlike the original Frameworks oval and circle mat opening cutter, does not require a rotating cutting board.

SUMMARY OF THE INVENTION

According to the present invention, there is provided a pressure sensitive mat opening cutter for cutting beveled oval and circular openings in picture frame mats. By pressure sensitive is meant that the depth of cut can be gradually increased in use by applying constant downward pressure against the blade. The pressure sensitive cutter incorporates a cutter body which mounts a cutting blade arrangement and in the bottom surface thereof a retractable cable which is used in conjunction with mat positioning pins on the mat surface to cut beveled oval and circular openings in the picture frame mat. Of special interest to the present invention is the incorporation of a control knob which can move up and down and rotate around a vertical axis. The knob is grasped and manipulated for achieving movement of the cutter and for gradually increasing the depth of cut being made by the cutting blade during use. The cutting blade arrangement is positioned beneath the control knob and downward movement of the control knob causes the blade to move downward to a depth which within limits is determined by the amount of downward pressure applied. A spring associated with the cutting blade is so arranged to cause the blade and the control knob to return to their original position once the downward pressure on the control knob is released. Thus, the cutter of the invention is effectively a pressure sensitive device for allowing gradual increase of depth of cut.

DESCRIPTION OF THE DRAWINGS

FIG. 4 is a front elevation view of the cutter of FIG. 1.

FIG. 5 is a rear elevation view of the cutter of FIG. 1.

FIG. 6 is a section view taken substantially along line 6—6 of FIG. 2 and illustrated in dashed lines the depressed or cutting position.

FIG. 7 is a side elevation view of the blade support bar.

FIG. 8 is a top plan view of the blade support bar.

FIG. 9 is a top plan view of a type of mat cutter blade employed with the cutter of the present invention.

FIG. 10 is a top plan view of a base plate employed in the present invention.

FIG. 11 illustrates, at a reduced scale, the mat opening cutter of the present invention in conjunction with a picture frame mat and positioning pins and being used for cutting an oval shaped opening according to the practice of the present invention.

DESCRIPTION OF THE PREFERRED EMBODIMENT

Figure 1:
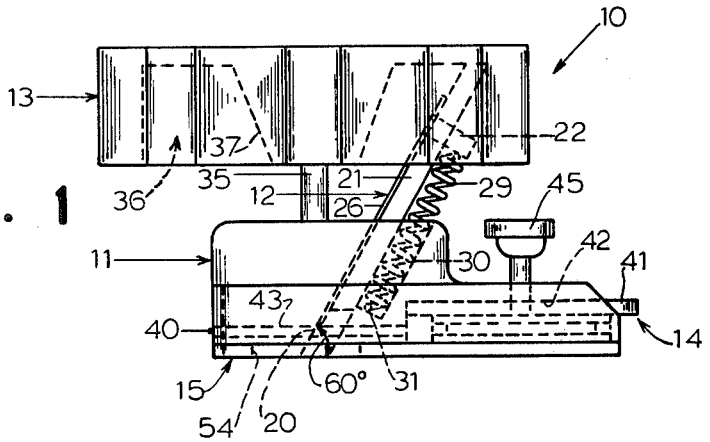
FIG. 1 is a side view of a mat opening cutter according to the present invention adapted for cutting oval and circular openings.
Figure 2:
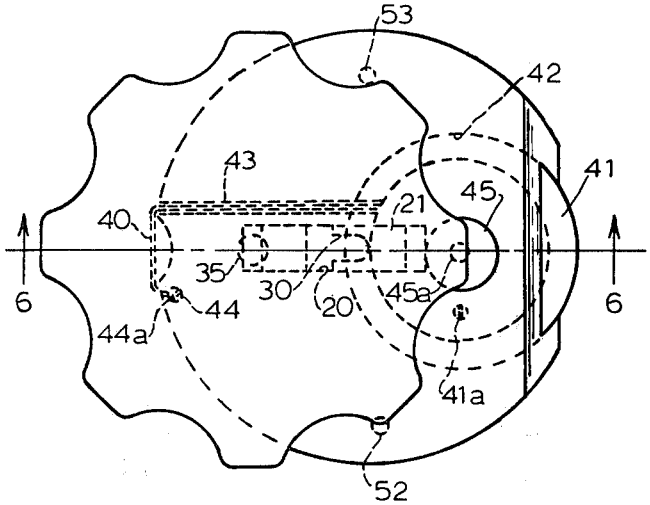
FIG. 2 is a top plan view of the cutter of FIG. 1.
Figure 3:
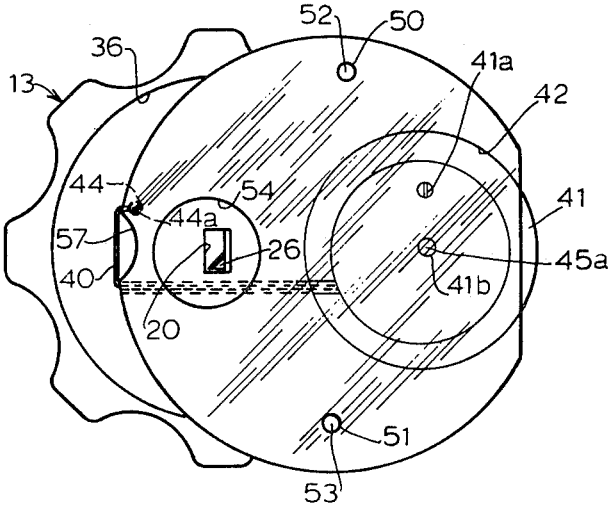
FIG. 3 is a bottom plan view of the cutter of FIG. 1.

Referring to the drawings, the picture frame mat opening cutter 10 of the present invention comprises a cutter body 11, a cutting blade arrangement 12, a rotatable and vertically movable control knob 13, a retractable cable arrangement 14, and a base plate 15.

Cutter body 11 slidably mounts, in a central, angularly disposed guide slot 20, a blade support bar 21. Angularly disposed guide slot 20 is preferably formed at an angle of substantially 60°. Blade support bar 21 has an integral pin 22 extending from its front surface 23 and through the body 24 to its back surface 25. The short portion of pin 22 extends from front surface 23 and mounts thereon a cutter blade 26. The short portion of pin 22 rests in an aperture 27 of cutter blade 26. The cutting edge 28 of cutter blade 26 extends beyond cutter bar 21 a sufficient distance to enable the cutting edge to be fully utilized. The longer portion of pin 22 extends from back surface 25 of cutter bar body 24 and is of sufficient length to retain an upper end of a coiled spring 29 therebeneath which rests in a mating portion 30 of guide slot 20 and has its lower end supported on ledge portion 31. Spring 29, thus, becomes compressed and limits travel during downward movement of blade support bar 21 and cutter blade 26 mounted thereon. Blade support bar 21 and cutter blade 26 are preferably mounted at a cutting angle of approximately 60° and slide together within cutter body 11 in guide slot 20 at that angle. Edge 28 extends forward of the post 35 centerline when in use.

The upright post 35 is integrally secured in cutter body 11 and extends upward from a predetermined location in the top surface portion of cutter body 11. Post 35 is designed to receive, in a vertically sliding fit relation, control knob 13 and on which control knob 13 also rotates. Control knob 13 is illustrated as a one piece molded member having a hollow inside void 36 and a central hub portion 37 which mounts on post 35 in a sliding fit relation as seen in FIG. 6. A bushing 38 in knob 13 and O-ring 39 on post 35 facilitates the sliding of knob 13 and bushing 38 on post 35 and securement of knob 13. In the raised position of the knob, O-ring 39 on post 35 abuts the upper surface of bushing 38 thereby limiting upward travel. Further, as will be apparent from the drawings, knob 13 may be removed to facilitate replacement of blade 26. The depth of hollow inside void 36 is such that the upper, flat horizontal end surface of blade support bar 21, when in a normal nondepressed position, rests against the flat inside top surface of hollow inside void 36 and the mating surfaces are designed to minimize friction as control knob 13 rotates during cutting. It will be apparent that as knob 13 is depressed and slides downward on post 35, blade support bar 21 and blade 26 will move downward against the force of spring 29 which becomes compressed against ledge 31. It will also be apparent that release of knob 13 will allow spring 29 to expand and move bar 21 and blade 26 upward within slot 20 and also allow knob 13 to return to the solid line FIG. 6 position. Since knob 13 also rotates on post 35, it can be seen that the depth of cut can be gradually increased by the constant application of pressure to knob 13 as the cutter body 11 moves during cutting of a mat with knob 13 held stationary with respect to the operator's hand. Thus, cutter 10 is best described as being pressure sensitive with respect to depth of cut.

Turning now to the retractable cable arrangement 14 for a description thereof, retractable cable arrangement 14 is made up of cable 40 and rotatable spool 41. Spool 41 is rotatably mounted in a recessed mating opening 42 which allows spool 41 to reside in opening 42 but still remain flush with the bottom surface of cutter body 11. Cable 40 is attached to spool 41 by metal tip **41*a* and wound about the hub portion of spool 41. Cable 40 passes through a hole 43 which opens at one end into recessed opening 42 and the other end of which exits adjacent the front edge of cutter body 11. Another hole 44 receives the free end of cable 40. Hole 44 begins in the bottom of cutter body 11 and exits adjacent hole 43 in the front edge of cutter body 11. Cable 40 is tied off at its free end or, as is illustrated, has a metal tip 44*a* which prevents cable 40 from being pulled back into hole 44 once tip 44*a* has been attached to cable 40. A portion of spool 41 extends beyond the sidewall of cutter body 11 and is capable of being rotated by the user of cutter 10. A thumb screw 45 has a threaded shaft portion 45*a* which passes through cutter body 11 and is screwed into a threaded mating hole 41*b* in spool 41. As screw 45 is tightened by turning thereof, section 46 of cutter body 11 is effectively clamped between the head of thumb screw 45 and spool 41, thus preventing rotation of spool 41 with respect to cutter body 11. Loosening of thumb screw 45 allows spool 41 to rotate. Blade edge 28 extends between spaced-apart holes 43 and 44**.

Base plate 15 is designed to align with and cover the base portion of cutter body 11 including the retractable cable arrangement 14. Base plate 15 has a pair of holes 50, 51 which snugly mount on a pair of pins 52, 53 integral with the base portion of cutter body 11 so that plate 15 is held tightly in place once mounted on pins 52, 53. Base plate 15 has a circular opening 54 which is centered over guide slot 20 at the point that it opens into the base of cutter body 11. Opening 54 allows support bar 21 and cutter blade 26 to pass therethrough to accomplish the cutting function, the description of which will be explained in detail later in the description. A circular wall portion 55 is also molded as an integral portion of base plate 15. Circular wall 55 is designed to reside over and around spool 41 and rests in recessed opening 42. A slot 56 in wall 55 aligns with hole 43 in cutter body 11 and permits cable 40 to pass from spool 41 through hole 43 to the front of cutter body 11. The bottom of base plate 15 is smooth and allows for smooth movement over the mat material which is to be cut. Base plate 15 has a semicircular cutout 57 which is located adjacent the front area of cutter body 11 where cable 40 exits therefrom. A mating semicircular cutout 58 is molded in the front area of cutter body 11. These two mating cutouts 57, 58 allow mat opening cutter 10 to get close to a positioning pin when oval or circular mat openings are being cut.

In using the cutter construction previously explained, both oval and circular-shaped beveled mat openings may be cut. FIG. 11 illustrates mat opening cutter 10 being used for cutting an oval-shaped opening in the mat material. Two mat positioning pins 65, 66 are shown appropriately positioned by techniques understood in the art and cable 40 is shown extending around pins 65, 66 with cutter 10 positioned to follow the imaginary cut line 67 which is defined by the selected length and width of the oval being formed. A circular opening is cut by using one mat positioning pin and with cable 40 being used to form the radius of the desired opening. Cutouts 57 and 58, in cutting circular openings, allow cutter 10 to cut a small circular opening since cutter 10 can get very close to the one pin now in use. As cutter 10 is moved to follow cut line 67, cable 40 is kept taut. Unlike any known hand-held and hand-manipulated prior art cutter, the depth of cut is not set and locked. Cutter 10 has its depth by the application of pressure in the downward direction by the operator on control knob 13. This downward force causes blade 26 to penetrate the mat material at a rate variable by the amount of pressure applied as the cutter is moved on the mat. Knob 13 also rotates on upright post 35 which allows cutter 10 to be controlled by knob 13 by application of outward pressure against cable 40 and downward pressure against the mat. The cutter 10 is moved along the imaginary cut line 67 with blade 26 tangential thereto.

It will be noted that the described knob slide surface arrangement allows the upper end slide surface of the angled blade support bar to move both vertically and radially when the knob is being pressed facilitating a smooth operation. Also, by having the extended edge of the blade slightly forward of the vertical centerline of the post on which the knob is mounted, the face of the blade is inclined to maintain a tangential relation to the curve being cut at the cutting edge by virtue of the outward pressure being applied against the cable. This relation is seen in FIG. 6. The location of the post behind the place where the cable exits the cutter and spacing of the two ends of the cable where attached to the cutter also assists in maintaining the tangential relation.

While the illustrated cutter is deemed most useful as a pressure sensitive cutter for cutting ovals and circles with beveled edges, it will be apparent to those skilled in the art that cutter body 11 could be modified to allow the blade 26, blade support 21, and spring 29 to operate in a vertical rather than in an angled orientation, as illustrated. With such an arrangement, vertical edges could be cut utilizing the pressure sensitive blade control feature described and also straight line cuts.

In summary, it can be seen that the present invention provides a cutter having a wide range of application but which is particularly suited to forming beveled oval and circular openings in picture frame mats and which has means for varying the depth of the cut being made as the cutter is being used. Thus, no locking means is needed for the cutter blade and which eliminates the need for stopping and adjusting the cutting depth which is often the case when it is desired for the blade to penetrate further into the material.

What is claimed is:

1. A picture frame mat opening cutter comprising:

(a) a body member having a flat bottom adapted for being moved on the work surface of a picture frame mat during the forming of an opening therein and having a guide slot formed and disposed at a predetermined angle therein;

(b) a blade support bar slidably mounted in said guide slot and providing a blade mounting surface thereon;

(c) a mat opening cutter blade having a cutting edge and detachably mounted on said blade mounting surface for slidable movement therewith to extend and retract said edge below and above said body member bottom;

(d) compressible spring means mounted within said body member and operative to constantly tension said blade support bar and blade in a retracted blade edge direction;

(e) vertical post means located on a top surface portion of said body member; and (f) a knob member mounted for rotation and vertical sliding on said post means, said knob member having a manually operable knob portion and integral with said knob portion a guide portion providing a flat surface slidably engaging an upper end surface portion of said blade support bar thereby enabling said knob member when pressed downwardly by a downward force and while rotating on said post means to force said blade support bar and blade downwardly against the tension of said spring means to extend said cutting edge of said blade below said flat bottom of said body member to a depth which within the limits of travel of said blade support bar and blade is determined by the amount of said downward force applied to said knob member.

2. A picture frame mat opening cutter as claimed in claim 1 including a spool member mounted in a bottom portion of said body member and including a flexible retractable cable wound thereon with an outer end secured at a first point on said body member, said cable being adapted to be withdrawn from said body member at a second point laterally spaced from said first point so as to allow said cable to extend forward of said cutter blade for encircling appropriate mat positioning pins to form oval, circular openings, and the like, in a selected picture frame mat and means for locking said spool means in a selected position with said cable withdrawn a selected amount.

3. A picture frame mat opening cutter as claimed in claim 1 including a base plate forming the said flat bottom of and removably mounted on said body member so as to enclose said spool member and said cable wound thereon, said base plate having means for allowing said blade support bar and said blade mounted thereon to pass therethrough for penetration of mat material being cut by said blade.

4. A picture frame mat opening cutter as claimed in claim 1 wherein said guide slot is formed and disposed so as to mount said blade support bar and blade to cut bevel edges of substantially 60°.

5. A picture frame mat opening cutter as claimed in claim 1 wherein said guide slot is formed and so disposed as to mount said blade support bar and blade to cut bevel edges at an acute angle.

6. A picture frame mat opening cutter as claimed in claim 1 wherein said knob portion of said knob member surrounds the guide portion thereof.

7. A picture frame mat opening cutter as claimed in claim 2 wherein said guide slot and blade support bar are arranged with respect to said post means and said first and second cable points to allow said blade cutting edge when extended to reside forward of the vertical centerline of said post means and between said points thereby enabling the face of the blade at the cutting edge to maintain a tangential relation with the curve being cut.

8. A picture frame mat opening cutter as claimed in claim 3 wherein said guide slot is formed and so disposed as to mount said blade support bar and blade to cut bevel edges at an acute angle and wherein said knob portion of said knob member surrounds the guide portion thereof.

* * * * *

UNITED STATES PATENT AND TRADEMARK OFFICE

CERTIFICATE OF CORRECTION

PATENT NO. : 4,233,736

DATED : November 18, 1980

INVENTOR(S) : Richard W. Duggins et al

It is certified that error appears in the above—identified patent and that said Letters Patent is hereby corrected as shown below:

Col. 6, line 35, change "claim 1" to --claim 2--.

Signed and Sealed this

*Twenty-second* Day of *September 1981*

[SEAL]

*Attest:*

GERALD J. MOSSINGHOFF

*Attesting Officer*

*Commissioner of Patents and Trademarks*